US009151281B2

(12) United States Patent
Donnette et al.

(10) Patent No.: US 9,151,281 B2
(45) Date of Patent: Oct. 6, 2015

(54) PUMP FOR DELIVERING A PRODUCT, COMPRISING A PISTON SLIDING IN THE METERING CHAMBER

(71) Applicants: Xavier Donnette, Soleymieu (FR); Jose Camba, Amberieu en Bugey (FR); Philippe Sahm, Aix les Bains (FR)

(72) Inventors: Xavier Donnette, Soleymieu (FR); Jose Camba, Amberieu en Bugey (FR); Philippe Sahm, Aix les Bains (FR)

(73) Assignee: Rexam Healthcare La Verpilliere S.A.S. (FR)

( * ) Notice: Subject to any disclaimer, the term of this patent is extended or adjusted under 35 U.S.C. 154(b) by 0 days.

(21) Appl. No.: 13/709,791

(22) Filed: Dec. 10, 2012

(65) Prior Publication Data

US 2013/0164156 A1 Jun. 27, 2013

Related U.S. Application Data

(63) Continuation of application No. PCT/FR2011/051319, filed on Jun. 9, 2011.

(30) Foreign Application Priority Data

Jun. 10, 2010 (FR) ..... 10 54607

(51) Int. Cl.

| | |
|---|---|
| ***F04B 53/12*** | (2006.01) |
| ***F04B 9/08*** | (2006.01) |
| ***B05B 11/00*** | (2006.01) |

(52) U.S. Cl.

CPC ..... *F04B 9/08* (2013.01); *B05B 11/0075* (2013.01); *B05B 11/3004* (2013.01);

(Continued)

(58) Field of Classification Search

CPC ..... F04B 39/1086; F04B 39/108; F04B 39/1033; F04B 39/1026; F04B 53/1062; F04B 13/00; F04B 53/106; F04B 53/1075; F04B 53/12–53/129; F04B 9/08; F16K 15/144; F16K 15/147; B05B 11/3004; B05B 11/3067; B05B 11/3069; B05B 11/0075; B05B 11/3047; B05B 11/0064; B05B 11/0067

USPC ..... 417/545–554; 137/516.11–516.23, 843, 137/851, 852, 853, 859

See application file for complete search history.

(56) References Cited

U.S. PATENT DOCUMENTS 3,942,916 A * 3/1976 de Leeuw ..... 417/568
4,646,781 A * 3/1987 McIntyre et al. ..... 137/512.4

(Continued)

FOREIGN PATENT DOCUMENTS

FR 2664353 A1 1/1992
FR 2699390 A1 6/1994

(Continued)

OTHER PUBLICATIONS

International Search Report Application No. PCT/FR2011/051319 Completed: Aug. 23, 2011; Mailing Date: Aug. 31, 2011 2 pages.

*Primary Examiner* — Peter J Bertheaud
*Assistant Examiner* — Dnyanesh Kasture
(74) *Attorney, Agent, or Firm* — St. Onge Steward Johnston & Reens LLC

(57) ABSTRACT

The pump includes a piston slidably mounted in a metering chamber, the piston including a support, a diaphragm made of a first material and forming a check valve that allows fluid to flow into the metering chamber, and a presser element for pressing the diaphragm against the support, the presser element including a skirt carrying seal enabling the piston to slide in leaktight manner in the metering chamber, the presser element being made of a second material different from the first material of the diaphragm, being fitted against the diaphragm, and having a diaphragm presser surface that holds the diaphragm deformed against the support in order to close the check valve.

16 Claims, 3 Drawing Sheets

(52) U.S. Cl.
CPC ..... *B05B 11/3067* (2013.01); *B05B 11/3069* (2013.01); *B05B 11/0064* (2013.01); *B05B 11/0067* (2013.01); *B05B 11/3047* (2013.01)

(56) References Cited

U.S. PATENT DOCUMENTS

| | | | | | |
|---|---|---|---|---|---|
| 4,823,974 | A | * | 4/1989 | Crosser | 62/457.3 |
| 5,305,795 | A | * | 4/1994 | Forberg | 137/859 |
| 5,620,314 | A | * | 4/1997 | Worton | 417/550 |
| 5,927,957 | A | * | 7/1999 | Kennedy et al. | 417/511 |
| 6,089,272 | A | * | 7/2000 | Brand et al. | 137/859 |
| 2004/0211400 | A1 | * | 10/2004 | Basset | 123/572 |
| 2006/0140782 | A1 | * | 6/2006 | Weber | 417/221 |
| 2008/0116227 | A1 | * | 5/2008 | Leuliet et al. | 222/321.9 |
| 2009/0020565 | A1 | * | 1/2009 | Nicolle et al. | 222/394 |

FOREIGN PATENT DOCUMENTS

| | | | |
|---|---|---|---|
| FR | 2765560 | A1 | 1/1999 |
| FR | 2885890 | A1 | 11/2006 |

* cited by examiner

PUMP FOR DELIVERING A PRODUCT, COMPRISING A PISTON SLIDING IN THE METERING CHAMBER

FIELD OF THE INVENTION

The present invention relates to the technical field of delivering liquid, semi-liquid, or viscous composition, in particular in the medical field. The device comprises a pump for sucking in and dispensing the fluid contained in a reservoir. The device may be used in particular for nasal sprays.

BACKGROUND OF THE INVENTION

In a pump example described in document FR 2 885 890, the pump comprises a resilient diaphragm having a portion that forms a check valve so as to prevent the fluid returning from the metering chamber back into the reservoir. The resilient diaphragm is fitted on a support through which a feed channel passes, the support serving as a seat for the portion that forms the check valve so that the valve is pressed against the seat to block the liquid, or is spaced apart from the seat so as to allow it to pass. The diaphragm is slidably mounted in the metering chamber of the pump in leaktight manner in order to expel out from the chamber any fluid contained in the chamber. More precisely, the resilient diaphragm comprises a transverse wall forming the valve for closing the chamber feed channel, and a cylindrical skirt having one or two peripheral sealing lips in sliding contact with the inner wall of the metering chamber.

It is also known that certain pumps are configured to deliver fluid without intake of air, thereby making it possible in particular to avoid using preservatives. In such devices in particular, any introduction of air into the pump or the reservoir is to the detriment of the accuracy with which doses are delivered and to the sterility of the fluid that is delivered.

SUMMARY OF THE INVENTION

The present invention seeks in particular to propose a pump that delivers more accurate doses.

To this end, the invention relates to a pump for delivering a fluid, wherein the pump comprises a piston slidably mounted in a metering chamber, the piston comprising:

a support;

a diaphragm made of a first material and forming a check valve that allows fluid to flow into the metering chamber; and a presser element for pressing the diaphragm against the support, the presser element comprising a skirt carrying sealing means enabling the piston to slide in leaktight manner in the metering chamber, the presser element being made of a second material different from the first material of the diaphragm, being fitted against the diaphragm, and having a diaphragm presser surface that holds the diaphragm deformed against the support in order to close the check valve.

It is thus proposed that the sealing function and the check-valve function are performed by two parts rather than by a single resilient part, the two parts being the diaphragm and the presser element, which parts are made of two distinct materials. It is thus possible to adapt the material of each part to the function associated therewith, i.e. the check-valve function for the diaphragm and the function of pressing or of sliding in a metering chamber for the presser element. The material of the presser element is preferably more impermeable to air than is the material of the diaphragm, thereby avoiding any introduction of air into the pump by air diffusing through the material, in particular through the cylindrical skirt.

In an advantageous embodiment, the first material is relatively flexible, while the second material is relatively rigid, i.e. the material of the presser element is more rigid than the material of the diaphragm. A flexible material, such as silicone for example, is relatively permeable to air because air molecules can easily diffuse through the material. So, the fact of using a material that is less air-permeable for the presser element avoids air being introduced into the device by diffusing through the walls of the presser element. Furthermore, the diaphragm performs the check-valve function in satisfactory manner because it is resilient. Indeed, it is thus sufficiently flexible to be capable of taking up a configuration in co-operation with the support in which the fluid is blocked, and a configuration in which the fluid can pass, the fluid-blocking configuration preventing the fluid from returning back into the feed channel once the fluid is in the metering chamber. These two functions ensure proper operation of the pump and thus provide a device that is more reliable. In addition, since the sealing means are made of rigid material, the sliding between these means and the wall of the metering chamber takes place with less friction and therefore generates less wear of the sealing means, while requiring less force from the user in order to actuate the pump. In addition, a part made of rigid material may be less likely to react on contact with the fluid, and also makes better control over dimensions possible and thus enables the various parts to better fit relative to one another in the metering chamber.

The above-described pump is particularly advantageous when it is used without air intake. This type of pump is commonly referred to as an "airless" pump. In such a pump, once the pump has been primed, i.e. once the air contained in the metering chamber has been completely replaced by the fluid to be delivered, the fluid expelled from the reservoir on each utilization is not replaced by air coming in from the outside. As a result, as utilization progresses, suction is established within the reservoir which may lead to air leaking into or being sucked into the device, and may cause gas to enter by diffusing through the walls of the device. Such entry of air is troublesome since the metering chamber or the dip tube immersed in the reservoir are then no longer filled only with the fluid, and that degrades the accuracy of the doses of fluid that are delivered and leads to the pump becoming slightly unprimed. This entry of air also increases over time, such that the accuracy of the doses decreases over time. Since the presser element is made of a material that is different from that of the diaphragm, it is possible to select a material that is less air-permeable than the material of the diaphragm, such that the diffusion of air through the presser element is as small as possible and such that practically no air enters into the metering chamber. Thus, since the entry of air into the metering chamber is negligible, the doses supplied are particularly accurate, with this continuing over a long duration. Thus, given the very small quantity of gas that can penetrate into the system, the volume delivered by the pump is always substantially constant, even if it has not been activated for a long period (e.g. five or even seven days).

Another advantage of the above-proposed pump lies in the fact that the presser member and the diaphragm are elements that are fitted relative to each other, i.e. they are manufactured separately and they do not form a part in a single piece. Should it be necessary, they can be removed independently of each other. It is more advantageous to mount two parts separately in the pump than it is to make them directly so that they are secured to each other (e.g. by adhesive, overmolding, or by bi-injection), since these parts are of particularly small size, and securing them to each other by adhesive, overmolding, or bi-injection is difficult and can give rise to leaks. Furthermore, the diaphragm is held on the support so that a portion of the diaphragm is sandwiched between the support and the presser element on the diaphragm. In addition, since the parts are separate, there is no interference between the check-valve function and the sealing function, which interference might otherwise occur when the two functions are provided by a part in a single piece. The elastic deformation of the diaphragm has no effect on the presser element, and thus on the sealing means, with the diaphragm merely being pressed in a deformed state against the support by the presser element. An additional advantage of making the diaphragm and the presser element separately lies in the fact that it is very easy to modify the shape of the diaphragm as a function of the fluid to be delivered. It is possible to increase or reduce its deformation against the support, and thus to increase or reduce the force required for releasing the fluid. It is thus easy to adapt the pump to the viscosity of the fluid to be delivered. It is thus easier to optimize the diaphragm and the presser element.

It should be observed that when the diaphragm is in the fluid-blocking configuration, it is preferably elastically deformed so that it closes the passage under the effect of its own resilient return force. When it is in the fluid-passing configuration, the diaphragm is subjected to additional deformation under the effect of the suction in the metering chamber, corresponding to amplifying the deformation provided in the blocking configuration, thereby detaching it from the support to allow the fluid to pass.

In general, the terms "top" or "upper" are used to designate anything located towards the fluid dispenser endpiece, and the terms "bottom" or "lower" to designate anything located beside the reservoir on which the pump is mounted. It should also be observed that the piston is mounted to slide in the metering chamber between a rest position, also referred to as low position, and an activated position, also referred to as high position. The metering chamber thus defines a metering volume that corresponds to the difference between the volume of the chamber in the low position and the volume of the chamber in the high position, also referred to as the "dead volume".

The pump may also include one or more of the following characteristics.

The diaphragm is made of silicone, of propylene/ethylene copolymers, of polyether block amides, of polyvinyl, of ethylene, propylene, and diene terpolymer (EPDM), of a sequenced styrene-butadiene polymer (SBS), of a sequenced styrene-ethylene-butadiene polymer (SEBS-SIS), of polyurethane, of butyle or nitrile rubbers; of latex, of fluorinated elastomers, or of a mixture of polypropylene with one of the following elastomers: sequenced styrene-ethylene-butadiene polymers (SEBS-SIS), ethylene, propylene and diene terpolymers (EPDM), sequenced styrene-butadiene polymers (SBS). It should be observed that silicone is particularly advantageous because it presents good resistance to creep (it conserves its properties well over time, even when subjected to stress), good chemical inertness, and good suitability for unmolding by injection.

The presser element is made of high or low density polyethylene, of polypropylene, of polyester, of polyacetal, of ethylenevinyl acetate, or of mixtures thereof, which are materials having smaller air-permeability and thus making it possible to ensure that the time required to take in air is several days. Furthermore, the sliding sealing means carried by the skirt are molded integrally with the skirt of the presser element, thereby making the metering chamber airtight.

The skirt has a top end and a bottom end, and the sliding sealing means are carried by the top end of the skirt, e.g. comprising a circular lip. Because the lip is at the top of the skirt, the dead volume of the metering chamber is small and this optimizes priming of the pump. Furthermore, the circular lip may for example be frustoconical in shape, extending towards the top end of the pump, with the narrower portion being at the bottom end of the lip, i.e. co-operating with the skirt to form a V-shape with its opening facing towards the top portion of the pump. As a result, when the user actuates the pump and compresses the liquid contained in the metering chamber, the liquid pressure increases the force that presses said lip against the inner walls of the metering chamber, thereby improving sealing, while minimizing contact areas. The sealing means may also be in the form of an annular bead or any other form suitable for providing sealing.

The diaphragm comprises a central disk carrying means forming a check valve by co-operating with the support, and a positioning edge connected to the disk by a perforated wall that allows fluid to pass therethrough. The positioning edge is pressed against the presser surface of the presser element. It can be understood that in the fluid-blocking configuration, the disk of the diaphragm is preferably pressed by resilient return against the support, and more precisely against the seat-forming top end of the support under the effect of the pressure of the fluid contained in the metering chamber. Furthermore, in the fluid-passing configuration, the disk is lifted off the seat, mainly by elastic deformation of the perforated wall, under the effect of the suction created when the piston goes from the high position to the low position so as to create a space for passing the fluid. It should be observed that the positioning edge may be a ring, but it need not necessarily be a continuous ring, since it has the function of positioning the diaphragm at a certain height relative to the support so that the disk remains pressed against the seat in order to close the valve. The positioning edge is held at this height by the presser surface of the presser element that exerts pressure against the edge. It should be observed that by modifying the thickness or the shape of the positioning edge, it is very simple to modify the deformation of the diaphragm, and thus to vary the pressure required for opening the valve.

The support has a substantially cylindrical outer surface carrying second sealing means that enable the skirt to be fastened in leaktight manner on the support. These second sealing means prevent liquid or air from passing between the support and the presser element. By way of example, they may comprise an annular bead or lip going around the outer surface of the support. They may also be the same as the means for fastening the skirt on the support. Thus, sealing of the metering chamber relative to the pump body is guaranteed by the presser element, which is preferably rigid. It should be observed that the piston proposed herein needs only to provide two seals between parts in order to prevent leaks between the inside and the outside of the pump, i.e. sliding sealing between the presser element and the chamber, provided by the first means, and sealing between the presser element and the support, provided by the second means. There is no need to provide sealing between the diaphragm and the presser element, thus facilitating assembly and providing a device that is more reliable.

The support includes a shoulder against which the bottom end of the skirt comes into abutment. As a result, the presser element and thus the diaphragm are positioned vertically relative to the support in permanent manner, thereby guaranteeing satisfactory operation of the valve. In addition, a claw may be provided that exerts a force on a frustoconical surface provided on the support, thereby providing a force that presses the presser element against the support and thus maintains the axial position more reliably.

The presser element includes fastener means for snap-fastening on the support, the fastener means comprising a groove co-operating with a lug or an annular rib formed on the support.

The presser element comprises a transverse wall integrally molded with the skirt, and including a solid central portion. This central portion preferably makes it possible to limit the movement of the diaphragm and to avoid it separating or becoming dislodged from the support by excessive deformation of the diaphragm. In a particularly advantageous embodiment, a top needle closing the metering chamber can come into abutment against the central portion while priming the pump, thereby enabling the air contained in the metering chamber to be exhausted.

The pump operates without intake of air.

BRIEF DESCRIPTION OF THE DRAWINGS

The invention can be better understood on reading the following description given purely by way of example and made with reference to the drawings, in which.

DETAILED DESCRIPTION OF THE INVENTION

Figure 1:
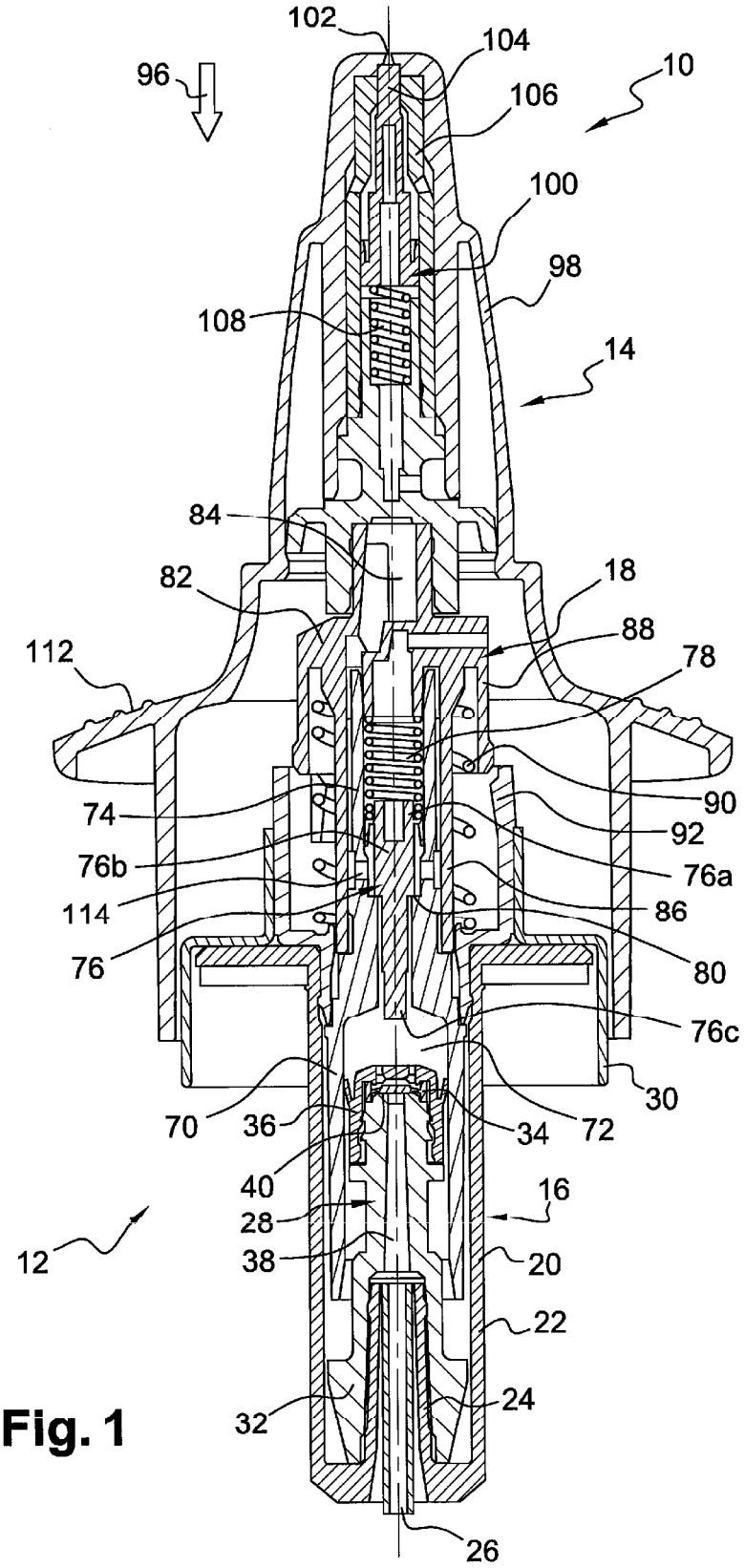
FIG. 1 is a section view of a fluid delivery device in an embodiment.

FIG. 1 shows a fluid delivery device 10 comprising a pump 12 surmounted by a fluid dispenser endpiece 14. The device is used for example for delivering a pharmaceutical fluid as a nasal spray. The pump 12 is for mounting on a reservoir (not shown).

The pump 12 comprises a first portion 16 referred to as a "stationary" portion, and a second portion 18 referred to as a "movable" portion or dispenser head, which portion is movable relative to the stationary portion 16.

The stationary portion 16 of the pump 12 preferably includes a pump body 20 comprising an outer cylinder 22 connected to an inner cylinder 24 for receiving a dip tube 26. The dip tube 26 is immersed in the reservoir when the device is mounted on the reservoir so as to draw the fluid to be delivered. The pump body 20 carries a piston 28 fitted on the inner cylinder 24. The stationary portion 16 of the pump also comprises a fastener collar 30 enabling the pump 12 to be crimped on the reservoir. Alternatively, the pump 12 may also be mounted on the reservoir by screw-fastening or by snap-fastening.

The piston 28 has a support 32, a diaphragm 34 forming a check valve, and a presser element 36 for pressing the diaphragm 34 against the support 32.

In this example, the support 32 is generally tubular in shape and is mounted stationary on the inner cylinder 24. It has a feed channel 38 passing therethrough, which channel is arranged to extend the tube 26 and leads to a feed orifice provided at the top end of the support. Alternatively, the support 32 may be integrally molded with the pump body 20 and may be constituted by the inner cylinder 24, the feed channel 38 then possibly being constituted by all or part of the inner cylinder 24. The top end of the support 32 is covered by the diaphragm 34 and it defines a bearing seat 40 for the diaphragm 34. The diaphragm 34 is pressed by elastic deformation against the seat 40 by means of the presser element 36.

Figure 2:
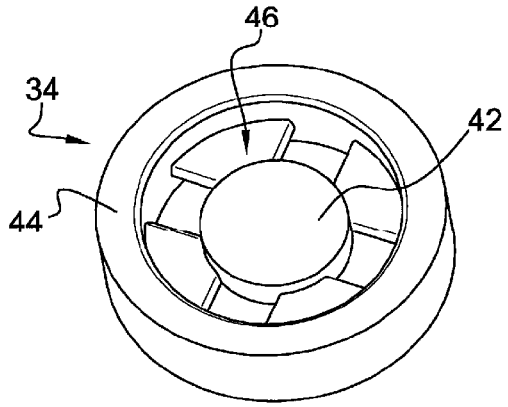
FIG. 2 is a perspective view of the diaphragm in an embodiment.

FIG. 2 is a perspective view of an embodiment of the diaphragm. It comprises a central disk 42 carrying check-valve-forming means that co-operate with the support 32 and a positioning edge 44 connected to the disk 42 by a perforated wall 46 that allows fluid to pass through. In this embodiment, the positioning edge 44 is annular in shape.

Figure 4:
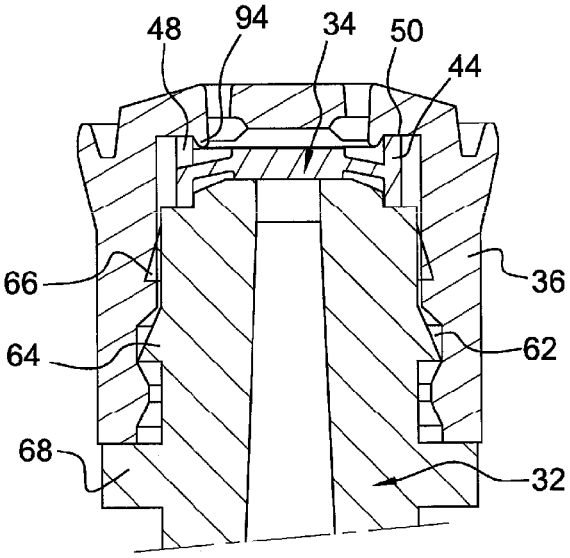
FIG. 4 is an enlarged section view of the top portion of the piston in an embodiment.

Since the diaphragm 34 is not intended to provide sealing between the support 32 and the presser element 36, the positioning edge 44 may have discontinuities 48, as shown in FIG. 4; it is not necessarily continuously annular in shape. The positioning edge 44 enables the central disk 42 to be pressed against the bearing seat 40 of the support 32 by elastic deformation of the diaphragm 34 and more particularly of the perforated wall 46. The elastic deformation of the diaphragm 34 is obtained by pressing a presser surface 50 of the presser element 36 against the positioning edge 44 of the diaphragm 34. The presser surface 50 preferably deforms the diaphragm 34 by moving the positioning edge 44 towards the support 32 and holding the diaphragm 34 in a fluid-blocking configuration.

The diaphragm 34 is made of a material that is relatively flexible and elastic, e.g.: of silicone, of propylene/ethylene copolymers, of polyether block amides, of polyvinyl, of ethylene, propylene, and diene terpolymer (EPDM), of a sequenced styrene-butadiene polymer (SBS), of a sequenced styrene-ethylene-butadiene polymer (SEBS-SIS), of polyurethane, of butyle or nitrile rubbers; of latex, of fluorinated elastomers, or of a mixture of polypropylene with one of the following elastomers: sequenced styrene-ethylene-butadiene polymers (SEBS-SIS), ethylene, propylene and diene terpolymers (EPDM), sequenced styrene-butadiene polymers (SBS).

The presser element 36 may be made of a material that is less permeable than the elastic material of the diaphragm, for example: of high or low density polyethylene, of polypropylene, of polyester, of polyacetal, of ethylenevinyl acetate, or of mixtures thereof.

In this example, the material of the presser element 36 that is less permeable to air is more rigid than the material of the diaphragm 34. Nevertheless, in other examples, the material is not necessarily more rigid, it could merely be different from the material of the diaphragm 34, and preferably more impermeable to air.

Figure 3:
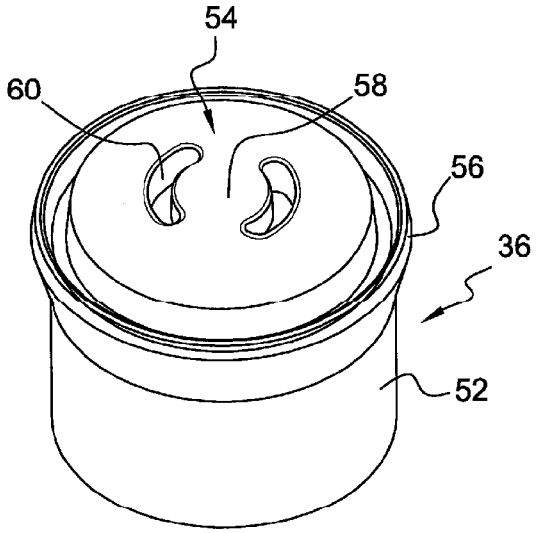
FIG. 3 is a perspective view of the presser element in an embodiment.

In an embodiment shown in FIGS. 3 and 4, the presser element 36 comprises a skirt 52 and a perforated transverse wall 54 made integrally with the skirt 52. The skirt 52 carries a circular lip 56 on its top end that might possibly be frusto-conical in shape and that extends towards the top end of the pump, its narrower portion being at the bottom end of the lip, i.e. it co-operates with the skirt to form a V-shape with its opening facing towards the top portion of the pump. This lip 56 forms the first sealing means of the pump. The transverse wall 54 has a solid central portion 58, and in this embodiment two fluid-passing orifices 60.

It can also be seen in FIG. 4 that the skirt 52 of the presser element 36 includes fastener means 62 for fastening the presser element on the support 32. In the present example, these fastener means 62 are embodied by an annular groove in the inside wall of the skirt 52 co-operating by snap-fastening with lugs 64 or with an annular rib 64 made on the support. Naturally, it is possible to provide only one lug 64. The lugs or the rib may be made integrally with the support 32. The means 62 and 64 also serve to center and press the presser element 36 against the support 32. Furthermore, the support 32 has a cylindrical outside surface carrying second sealing means to ensure leaktight fastening of the presser element 36 on the support 32. By way of example, these second sealing means 66 may comprise an annular rib that provides the assembly with sealing by deformation of the inner wall of the presser element. It can also be seen that the support 32 has a shoulder 68 against which the bottom end of the skirt 52 comes into abutment. On the inner surface of the transverse wall 54, the presser element 36 carries a centering rib 94 that enables the diaphragm 34 and the presser element 36 to be centered easily and quickly.

The support 32, the diaphragm 34, and the presser element 36 are distinct parts.

The movable portion 18 of the pump comprises a first cylinder 70 slidably mounted inside the pump body 20 and co-operating with the piston 28 and more precisely with the presser element 36 to define the metering chamber 72. In other words, the piston 28 is slidably mounted in the first cylinder 70 and thus in the metering chamber 72. The leaktight sliding of the piston 28 and thus of the presser element 36 in the metering chamber 72 is ensured by the first sealing means 56 carried by the skirt 52 of the presser element 36.

The chamber 72 defines a metering volume corresponding to the difference between the volume of the chamber 72 when the piston 28 is in the high position and the volume of the chamber 72 when the piston 28 is in the low position. This metering chamber determines the dose of fluid that is delivered on each activation of the device.

The movable portion 18 also includes a second cylinder 74 made integrally with the first cylinder 70. Naturally, the cylinders 70 and 74 could be made as a plurality of parts. A needle 76 is slidably mounted inside the second cylinder 74 to slide between a rest position and an activated position under drive from first return means 78 made up of a compression spring. The needle 76 is provided with a base 76*a* mounted in leaktight manner in the second cylinder 74, with a rod 76*b* configured to be capable in the rest position of the pump of closing an orifice 80 formed in the bottom end of the second cylinder 74, and with an end 76*c* projecting a little into the metering chamber 72 when the needle 76 is in the activated position. This end 76*c* is configured to press against the solid central portion 58 of the presser element 36 when the movable portion 18 is in the activated position so as to guarantee that the orifice 80 opens during a priming stage of the device, thereby expelling air from the metering chamber 72 towards the top of the device.

The movable portion 18 also includes an element 82 that is mounted stationary relative to the first and second cylinders 70 and 74 and that defines a dispenser chamber 84. Naturally, the element 82 could be made integrally with the elements 70 and/or 74. It is generally on the element 82 that the dispenser endpiece 14 of the device is mounted, the chamber 84 being connected to a dispenser nozzle provided in the endpiece. It should be observed that the chamber 84 is not necessarily present on the support 82, it being possible to provide only a connection of the support 82 and/or of the cylinder 74 with the dispenser endpiece 14. The element 82 of the movable portion 18 is provided with an inner skirt 86 and an outer skirt 88, with second return means 90 being received between the skirts. The return means 90 comprise a compression spring bearing firstly against the element 82 between the two skirts 86 and 88, and secondly against the stationary portion 16 at the end of a sleeve 92. By means of the spring 90, the movable portion 18 that is movable relative to the stationary portion 16 between a rest position and an activated position, is held in a high position, as shown in FIG. 1. Inside the inner skirt 86, the element 82 also presents a bearing seat for the first spring 78. The element 82 also includes means for ensuring that the liquid can pass from the metering chamber 72 to the dispenser endpiece 14, and more particularly towards the dispenser chamber 84, which means are arranged in particular between the second cylinder 74 and the inner skirt 86, preferably in such a manner as to allow the liquid to pass without the liquid coming into contact with the return means 78 and 90.

The device also includes a dispenser endpiece 14 having a covering 98 that includes a duct 100 opening out in its top portion via a small-diameter spray orifice 102. A needle 104 inserted in a swirl chamber 106 of the duct 100 acts as a dispenser valve. The assembly comprising the needle 104, the swirl chamber 106, and the spray orifice 102 forms a spray nozzle. The needle 104 closes the spray orifice 102 and is held in this position by return means 108 bearing against the bottom end of the needle 104 and against a seat carried by the element 110. The covering also has finger supports 112 that enable the user to actuate the device.

There follows a description of how such a pump is assembled, where assembly comprises assembling together three subassemblies: the stationary portion 16, the movable portion 18, and the dispenser endpiece 14.

Figure 5:
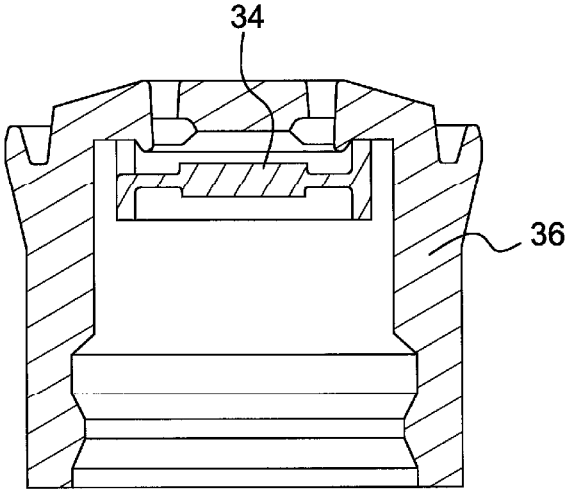
FIGS. 5 and 6 are section views of the stationary portion of the pump at different moments during assembly.
Figure 6:
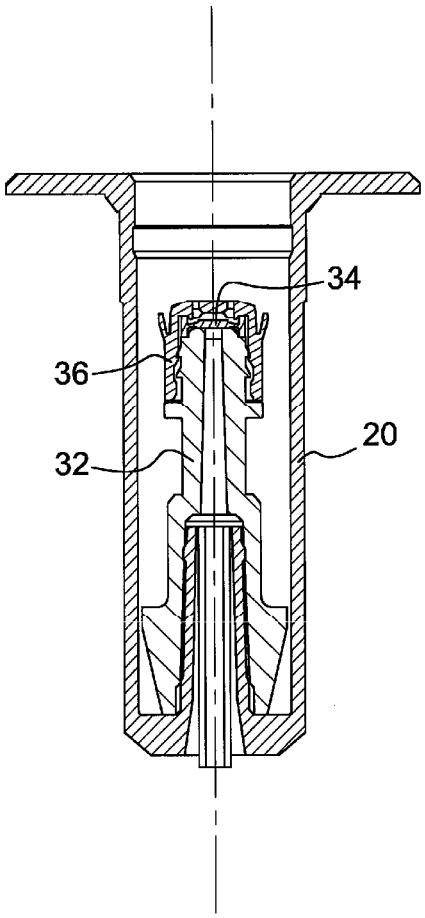

Firstly, assembly of the piston 28 is described. As shown in FIG. 5, the diaphragm 34 is placed inside the presser element 36. The diaphragm 34 can be seen in the non-deformed state. Thereafter these two elements are fitted onto the top end of the support 32, or vice versa. These three parts are held securely together by the annular rib 64 of the support 32 snap-fastening in the groove 62 carried by the inner surface of the skirt 52. Proper positioning of the diaphragm 34 and of the presser element 36 is provided not only by the co-operation between the groove 62 and the rib 64, but also by the bottom end of the skirt 52 being put into abutment against the shoulder 68 of the support 32. When the presser element 36 is fastened on the support 32, the presser surface 50 deforms the diaphragm 34 elastically, and more particularly deforms its perforated wall 46, and presses the central disk 42 against the bearing seat 40 of the support 32 in a fluid-blocking configuration, as shown in FIG. 4. The diaphragm 34 is thus sandwiched between the support 32 and the presser element 36.

Thereafter, the piston 28 is fitted on the pump body 20 having the dip tube 26 mounted thereon.

Thereafter the movable portion of the pump formed by the first and second cylinders 70 and 74, the needle 76, the element 82, the sleeve 92, and the springs 78 and 90 is assembled. The various elements are held together by mechanical clamping or by snap-fastening. This subassembly is then fitted on the stationary portion 16 of the pump. The system for fastening the pump on the reservoir is then fitted, which system is constituted in the present example by a crimping ring 30. It is also possible to provide a screw-fastener ring or a snap-fastener.

The last step consists in assembling together the various parts forming the dispenser endpiece and in fitting them on the pump. In the example described, the wall of the dispenser chamber 84 engages in a housing carried by the bottom end of the element 110 of the dispenser endpiece. The endpiece may itself be covered by a protective cap (not shown). The device 10 is ready for mounting on a reservoir by crimping the fastener collar 30 on the neck of the reservoir.

Naturally, the various assembly steps described above may be implemented differently or in a different order.

The operation of the device 10 when assembled on the reservoir is described below.

When mounted on the reservoir, the bottom end of the dip tube 26 is immersed in the fluid to be delivered.

Before first use, the movable portion 18 of the pump is in its high or rest position, and the metering chamber 72 is full of air. The diaphragm 34 is pressed against the support 32 in the fluid-blocking configuration. The spring 78 exerts a force on the needle 76 that holds the needle in its configuration for closing the orifice 80 by co-operation with the rod 76*b*, and the spring 90 holds the movable portion 18 of the pump in the high position.

On first use of the device 10, the user presses on the movable portion 18 of the pump, and more particularly on the finger supports 112 of the dispenser endpiece 14 while exerting a downward force (represented by arrow 96). Under the action of this force, the movable portion moves down and compresses the air contained in the metering chamber 72. Thereafter, the end 76*c* of the needle 76 comes into abutment against the solid central portion 58 of the presser element 36. At the end of its stroke, the rod 76*b* of the needle no longer closes the orifice 80 of the second cylinder 74 and the air can escape freely into the top portion of the device; the movable portion 18 is then in the low or activated position and the metering chamber 72 has its minimum volume.

When the user releases pressure on the endpiece 14, the spring 90 drives the movable portion upwards in the direction opposite to that of the arrow 96, and the spring 78 returns the needle 76 into its configuration for closing the orifice 80, thereby generating suction within the metering chamber 72. This suction causes the central disk of the diaphragm 34 to separate from the support 32 by elastic deformation of the diaphragm 34 and more particularly of the perforated wall 46 and/or of the central disk 42: the diaphragm 34 is then in its fluid-passing configuration. In this configuration, the deformation to which the diaphragm 34 is subjected corresponds to amplifying the deformation provided in the blocking configuration so that it becomes detached from the support 32 in order to allow the fluid to pass. The fluid can thus go past the check valve, through the orifices in the perforated wall 46, and enter into the metering chamber 72. Nevertheless, the additional deformation of the diaphragm 34 is limited by the solid central portion 58 of the transverse wall 54 of the presser element 36. This prevents the diaphragm from being dislodged.

At the end of the stroke, the movable portion 18 is once more in the high position, the metering chamber 72 is full of fluid, and the diaphragm 34 is once more pressed against the support 32 in the fluid-blocking configuration. The fluid contained in the metering chamber cannot escape therefrom, nor can air penetrate therein because sealing is provided by the first sealing means 56 between the first cylinder 70 of the movable portion and by the second sealing means 66 between the support 32 and the presser element 36. The check-valve-forming diaphragm 34 and the needle 76 are in the fluid-blocking configuration.

Repeating these operations primes the pump and makes it ready for use.

When the user seeks to deliver a dose of fluid, the user actuates the device once more by exerting force downwards on the finger supports 112 (in the direction of the arrow 96), and under the action of this force the movable portion 18 and thus the first and second cylinders 70 and 74 begin to move down, with the volume in the metering chamber 72 decreasing and the fluid it contains being put under pressure. The fluid cannot escape back into the reservoir nor can it escape out from the pump because of the first and second sealing means 56 and 64 and because of the diaphragm 34 acting as a check valve. The fluid therefore exerts upward pressure on the needle 76 so that the rod 76*b* is moved and no longer closes the orifice 80. The fluid can thus escape from the chamber 72. Once the fluid has gone through the orifice 80, it flows between the second cylinder 74 and the inner skirt 86 via a channel 114 formed in the wall of the second cylinder. It then passes into the dispenser chamber 84 leading to the dispenser endpiece 14. Thanks to the channels formed in the element 110, the liquid flows between the swirl chamber 106 and the duct 100 and then between the swirl chamber and the needle 106. The fluid exerts downward pressure on the needle 106 that, on moving in the direction of the arrow 96, allows the fluid to be sprayed by the spray orifice 102.

Once the movable portion 18 has reached its low position, i.e. once the dose of fluid has been dispensed, the user releases pressure on the movable portion 18, and the metering chamber 72 fills once more with fluid, as described above.

It is also observed that the fluid for dispensing never comes into contact with any of the three springs 78, 90, or 108.

Among the advantages of this device, it can be seen that the skirt 52 is made of a material that is less permeable to air than the material of the diaphragm, and that consequently the diffusion of air through its wall is particularly small, thereby obtaining better accuracy in the doses that are delivered.

It should be observed that the invention is not limited to the above-described embodiments.

The invention claimed is:

1. A pump for delivering a fluid, wherein the pump comprises a metering chamber slidably mounted over a piston, the piston comprising:

a support;

a diaphragm made of a first material and forming a check valve that allows fluid to flow into the metering chamber, wherein the diaphragm has a longitudinal axis perpendicular to a sealing face of the diaphragm; and a presser element that presses the diaphragm against the support, the presser element comprising a skirt carrying a seal enabling the piston to slide in leaktight manner in the metering chamber, the presser element being made of a second material different from the first material of the diaphragm, being fitted over the diaphragm with the skirt extending beyond the diaphragm in the longitudinal axis direction towards the support, and having a diaphragm presser surface that holds the diaphragm deformed against the support and closes the check valve;

wherein the presser element comprises a transverse wall on a distal end of the presser element and integrally molded with the skirt, the transverse wall including a homogeneous solid central portion, and wherein the diaphragm includes a homogeneous solid central portion adjacent to the homogeneous solid central portion of the transverse wall of the presser element.

2. The pump according to claim 1, wherein the first material is substantially flexible and elastic.

3. The pump according to claim 2, wherein the first material comprises silicone, propylene/ethylene copolymers, polyether block amides, polyvinyl, ethylene, propylene, diene terpolymer (EPDM), a sequenced styrene-butadiene polymer (SBS), a sequenced styrene-ethylene-butadiene polymer (SEBS-SIS), polyurethane, butyle or nitrile rubbers.

4. The pump according to claim 2, wherein the first material comprises latex, fluorinated elastomers, or a mixture of polypropylene with one of the following elastomers: sequenced styrene-ethylene-butadiene polymers (SEBS-SIS), ethylene, propylene and diene terpolymers (EPDM), sequenced styrene-butadiene polymers (SBS).

5. The pump according to claim 1, wherein the presser element is made of high or low density polyethylene, of polypropylene, of polyester, of polyacetal, of ethylenevinyl acetate, or of mixtures thereof.

6. The pump according to claim 1, wherein the skirt has a top end and a bottom end, and the sliding seal are carried by the top end of the skirt.

7. The pump according to claim 6, wherein the skirt comprises a circular lip.

8. The pump according to claim 1, wherein the diaphragm comprises a central disk forming a check valve by co-operating with the support, and a positioning edge connected to the disk by a perforated wall that allows fluid to pass therethrough.

9. The pump according to claim 1, wherein the support has a substantially cylindrical outer surface carrying a second seal that enable the skirt to be fastened in leaktight manner on the support.

10. The pump according to claim 1, wherein the support includes a shoulder against which the bottom end of the skirt comes into abutment.

11. The pump according to claim 1, wherein the presser element includes a fastener on a portion of the skirt which extends beyond the diaphragm for snap-fastening on the support.

12. The pump according to claim 11, wherein the fastener comprises a groove co-operating with a lug or an annular rib formed on the support.

13. The pump according to claim 1, configured to deliver the fluid without intake of air.

14. A pump for delivering a fluid, wherein the pump comprises a metering chamber slidably mounted over a piston, the piston comprising:

a support;

a diaphragm made of a first material and forming a check valve that allows fluid to flow into the metering chamber, wherein the diaphragm has a longitudinal axis perpendicular to a sealing face of the diaphragm; and a presser element that presses the diaphragm against the support, the presser element comprising a skirt carrying a seal enabling the piston to slide in leaktight manner in the metering chamber, the presser element being made of a second material different from the first material of the diaphragm, being fitted over the diaphragm with the skirt extending beyond the diaphragm in the longitudinal axis direction towards the support, and having a diaphragm presser surface that holds the diaphragm deformed against the support and closes the check valve;

wherein the presser element comprises a transverse wall on a distal end of the presser element and integrally molded with the skirt, the transverse wall including a homogeneous solid central portion, and wherein the diaphragm includes a homogeneous solid central portion adjacent to the homogeneous solid central portion of the transverse wall of the presser element, wherein the pump comprises a top needle closing the metering chamber, able to come into abutment against the central portion of the presser element while priming the pump, thereby enabling the air contained in the metering chamber to be exhausted.

15. The pump according to claim 14, wherein the presser element includes a fastener on a portion of the skirt which extends beyond the diaphragm for snap-fastening on the support.

16. The pump according to claim 15, wherein the fastener comprises a groove co-operating with a lug or an annular rib formed on the support.

* * * * *